United States Patent [19]

Thorson

[11] 4,390,329

[45] Jun. 28, 1983

[54] ROTARY FLUID PRESSURE DEVICE AND VALVE-SEATING MECHANISM THEREFOR

[75] Inventor: Clayton W. Thorson, Edina, Minn.

[73] Assignee: Eaton Corporation, Cleveland, Ohio

[21] Appl. No.: 179,914

[22] Filed: Aug. 20, 1980

[51] Int. Cl.[3] ..... F01C 1/10; F01C 19/08; F16K 25/00

[52] U.S. Cl. ..... 418/61 B; 137/625.21; 251/175; 251/180

[58] Field of Search ..... 418/61 B; 251/175, 180; 137/625.21

[56] References Cited

U.S. PATENT DOCUMENTS

| | | | |
|---|---|---|---|
| Re. 28,051 | 6/1974 | McDermott | 418/61 B |
| 3,572,983 | 3/1971 | McDermott | 418/61 B |
| 3,749,195 | 7/1973 | Vegners | 418/61 B |
| 4,171,938 | 10/1979 | Pahl | 418/61 B |
| 4,289,318 | 9/1981 | Cather, Jr. et al. | 418/61 B |

*Primary Examiner*—John J. Vrablik

*Attorney, Agent, or Firm*—C. H. Grace; L. J. Kasper

[57] ABSTRACT

A rotary fluid pressure device (11) is disclosed of the type including an internal gear set (17) defining expanding and contracting volume chambers (29). The device further includes a stationary valve member (19) and a rotary valve member (55) having engaging valve surfaces (71,73). A valve seating mechanism (75) includes an annular balancing ring member (77) having a valve-confronting surface (78) engaging an opposite surface (68) of the rotary valve. In accordance with the present invention, it has now been recognized that stalling of the device is normally caused by separation of the balancing ring from the rotary valve, rather than lift-off of the rotary valve from the stationary valve. There is disclosed several ways of modifying the valve seating mechanism to prevent substantial flow of leakage fluid through the balancing passages (107) which, in turn, causes a substantial pressure differential across the balancing ring, and separation of the balancing ring from the rotary valve. In one embodiment, the balancing ring includes an annular groove (105) which is sufficient to communicate substantially all leakage flow to a drain passage (66) defined by the rotary valve to prevent a build-up of pressure acting on the valve-confronting surface (78).

8 Claims, 10 Drawing Figures

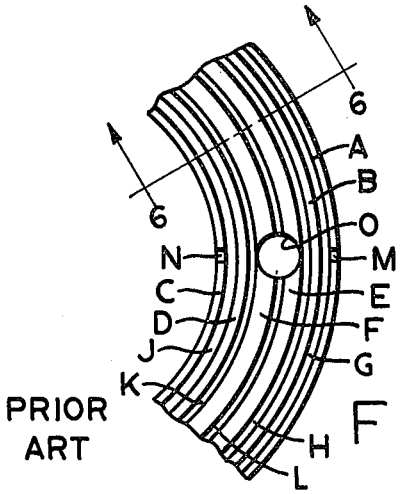
FIG. 5
FIG. 6
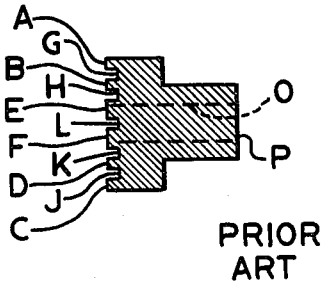
FIG. 8
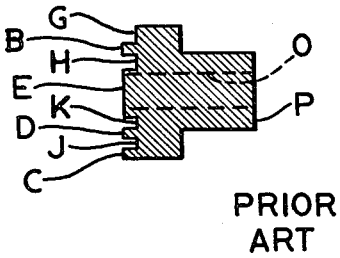
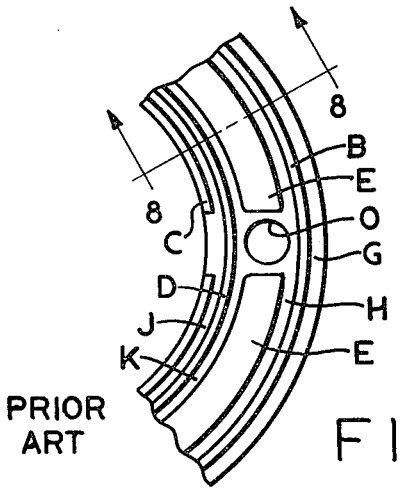
FIG. 7
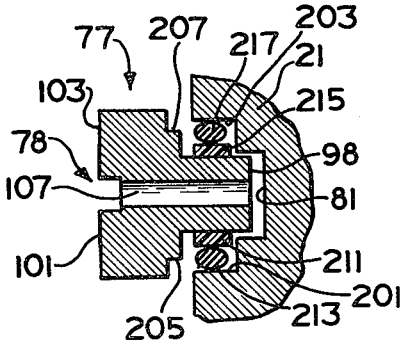
FIG. 9
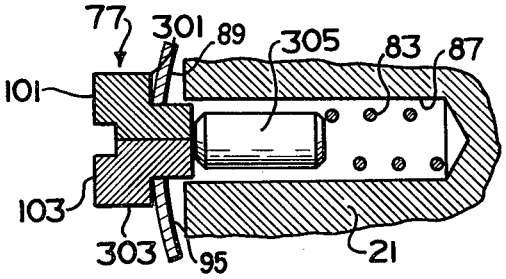
FIG. 10

ROTARY FLUID PRESSURE DEVICE AND VALVE-SEATING MECHANISM THEREFOR

BACKGROUND OF THE DISCLOSURE

The present invention relates to rotary fluid pressure devices, and more particularly, to such devices which include a pair of relatively rotatable valve members and a valve-seating mechanism operable to bias one of the valve members into tight, sealing engagement with the other valve member.

Although it will become apparent from the subsequent description of the invention that it may be useful with many types and configurations of rotary fluid pressure devices, including both pumps and motors, it is especially advantageous when used in a fluid motor, and will be described in connection therewith.

Also, although the invention may be used with devices having various types of fluid energy-translating displacement mechanisms, for example, axial piston devices, etc., the invention is especially adapted for use in a device including a gerotor displacement mechanism, and will be described in connection therewith.

Fluid motors of the type utilizing a gerotor displacement mechanism to convert fluid pressure into a rotary output are especially suited for low speed, high torque applications. Typically, in fluid motors of this type, the gerotor mechanism is of the type including a fixed internally toothed member (ring) and an externally toothed member (star) which is eccentrically disposed within the ring and orbits and rotates relative thereto. In fluid motors of this type there are normally two relatively movable valve members. One of the valve members is stationary and provides a fluid passage communicating with each of the volume chambers defined by the gerotor mechanism, while the other valve member rotates relative to the stationary valve member. If the rotatable valve member rotates at the orbiting speed of the star, the valving is referred to as "high speed", whereas if the valve member rotates at the rotational speed of the star, the valving is referred to as "low speed". Although the present invention may be used with motors having high speed valving, it is especially advantageous when used with low speed valving, and will be described in connection therewith.

A low speed, high torque gerotor motor of the type having low speed valving is illustrated in U.S. Pat. No. 3,572,983, assigned to the assignee of the present invention and incorporated herein by reference. Motors made in accordance with the cited patent constitute the known prior art relative to the present invention. Fluid motors made in accordance with the cited patent include, in addition to the previously mentioned stationary valve member and rotatable valve member, a valve-seating mechanism which is now generally well known in the art. The general function of the valve-seating mechanism is to exert a circumferentially-uniform biasing force, biasing the rotatable valve member into tight, sealing engagement with the stationary valve member.

One of the problems which has long been associated with fluid motors of the type described is a condition referred to as "stalling". Because the commutator valving action occurs at the plane surface of engagement of the two valve members, any axial separation of the two valve members will permit communication between high pressure fluid and low pressure fluid, thus eliminating the pressure differential across the gerotor mechanism, resulting in stalling. When stalling has occurred, it has generally been necessary to stop the flow of pressurized fluid to the motor, permitting the rotatable valve member to become reseated against the stationary valve member before starting operation again.

There have been several conditions believed to be responsible for this phenomenon of valve "lift-off" and stalling. Among these is excessive case pressure biasing the rotary valve away from the stationary valve. Another cause is believed to be manufacturing inaccuracies in the main spline connections which can result in a axial thrust force transmitted from the main drive shaft, through the valve drive shaft to the rotary valve. Attempts to overcome these and other suspected causes of valve lift-off have not previously been successful in eliminating the problem of stalling.

Accordingly, it is an object of the present invention to provide a rotary fluid pressure device in which the principal cause of stalling is determined and overcome.

It is a more specific object of the present invention to determine the existence of a cause for stalling which is unrelated to valve lift-off.

SUMMARY OF THE INVENTION

The above and other objects of the present invention are accomplished by the provision of an improved rotary fluid pressure device of the type including housing means defining a fluid inlet and a fluid outlet and a fluid energy-translating displacement mechanism defining expanding and contracting volume chambers. A stationary valve means defines fluid passage means in communication with the expanding and contracting volume chambers and has a first valve surface. A rotary valve member defines valve passage means providing communication between the inlet and outlet and the fluid passage means, and has a second valve surface in sliding, sealing engagement with the first valve surface. In addition, the rotary valve member has an opposite surface. The device includes a valve-seating mechanism including a generally annular balancing ring member having a transverse valve-confronting surface in engagement with the opposite surface of the rotary valve member. The balancing ring member also has a balancing surface and the ring member is axially movable relative to the rotary valve member. The valve-seating mechanism includes means biasing the valve-confronting surface into tight sealing engagement with the opposite surface. The balancing ring member cooperates with the housing means and the rotary valve member to define a first fluid chamber disposed radially inwardly from the ring member, and a second fluid chamber disposed radially outwardly from the ring member. The fluid inlet is in communication with one of the first and second chambers and the fluid outlet is in communication with the other of the chambers. The valve-seating mechanism defines balancing passage means permitting fluid communication between the valve-confronting surface and the balancing surface. The valve-confronting surface defines inner and outer sealing land means disposed to restrict fluid communication from the first and second fluid chambers, respectively, to the balancing passage means. The valve-seating mechanism includes pressure reducing means operable to maintain the pressure differential between the valve-confronting surface and the balancing surface less than the equivalent force of the biasing means when fluid flow across one of the sealing land means increases to a substantial portion of total flow from the fluid inlet to the fluid outlet.

BRIEF DESCRIPTION OF THE DRAWINGS

FIG. 5 is a fragmentary, front elevation view, similar to FIG. 2, illustrating a prior art balancing ring.

FIG. 6 is a transverse cross section taken on line 6—6 of FIG. 5.

FIG. 7 is a fragmentary, front elevation view, similar to FIG. 2, illustrating another prior art balancing ring.

FIG. 8 is a transverse cross section taken on line 8—8 of FIG. 7.

FIG. 9 is a transverse cross section, similar to FIG. 4, illustrating one alternative embodiment of the present invention.

FIG. 10 is a transverse cross section, similar to FIG. 3, illustrating another alternative embodiment of the present invention.

DESCRIPTION OF THE PREFERRED EMBODIMENTS

Figure 1:
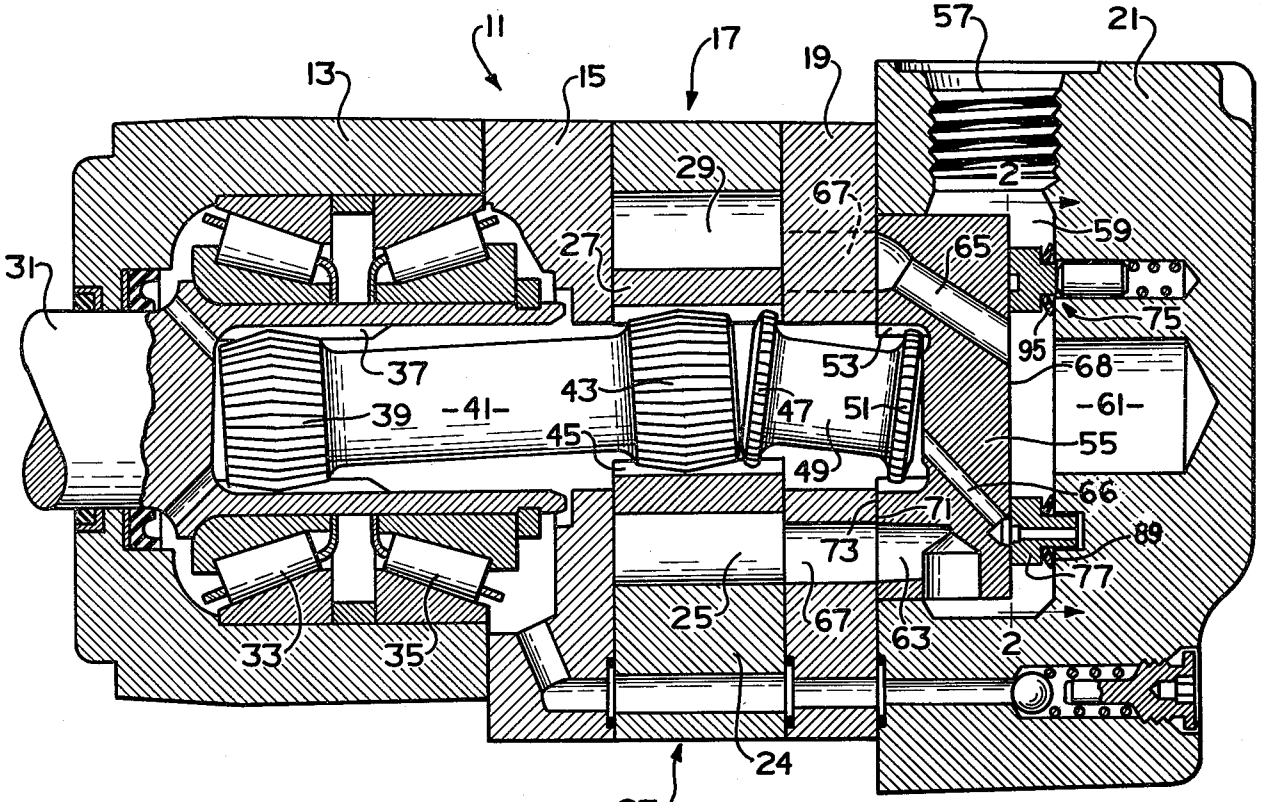
FIG. 1 is an axial cross section of a fluid motor of the type in which the present invention is preferably utilized.

Referring now to the drawings, which are not intended to limit the invention, FIG. 1 is an axial cross section of a fluid pressure actuated motor of the type to which the present invention may be applied, and which is illustrated and described in greater detail in U.S. Pat. No. 3,572,983, incorporated by reference hereinabove. It should be understood that the term "motor" when applied to such fluid pressure devices is also intended to encompass the use of such devices as pumps.

The hydraulic motor, generally designated 11, comprises a plurality of sections secured together, such as by a plurality of bolts (not shown). The motor 11 includes a shaft support casing 13, a wear plate 15, a gerotor displacement mechanism 17, a port plate 19, and a valve housing portion 21.

The gerotor displacement mechanism 17 is well known in the art and will be described only briefly herein. More specifically, in the subject embodiment, the displacement mechanism 17 is a Geroler ® displacement mechanism comprising an internally-toothed assembly 23. The assembly 23 includes a stationary ring member 24 defining a plurality of generally semi-cylindrical openings, and rotatably disposed in each of the openings is a cylindrical member 25, as is now well known in the art. Eccentrically disposed within the internally-toothed assembly 23 is an externally-toothed rotor member 27, typically having one less external tooth than the number of cylindrical teeth 25, thus permitting the rotor member 27 to orbit and rotate relative to the internally-toothed assembly 23. The relative orbital and rotational movement between the assembly 23 and the rotor 27 defines a plurality of expanding and contracting volume chambers 29.

Referring still to FIG. 1, the motor 11 includes an input-output shaft 31 positioned within the shaft support casing 13 and rotatably supported therein by suitable bearing sets 33 and 35. The shaft 31 includes a set of internal, straight splines 37, and in engagement therewith is a set of external, crowned splines 39 formed on one end of a main drive shaft 41. Disposed at the opposite end of the main drive shaft 41 is another set of external, crowned splines 43, in engagement with a set of internal, straight splines 45, formed on the inside diameter of the externally-toothed rotor member 27. Therefore, in the subject embodiment, because the internally-toothed assembly 23 includes six internal teeth 25, seven orbits of the rotor member 27 result in one complete rotation thereof, and as a result, one complete rotation of the main drive shaft 41 and the input-output shaft 31.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21, and the valve drive shaft 49 is splined to both the rotor member 27 and the valve member 55 in order to maintain proper valve timing, as is generally well known in the art.

The valve housing 21 includes a fluid port 57 in communication with an annular chamber 59 which surrounds the annular valve member 55. The valve housing 21 also includes another fluid port (not shown) which is in fluid communication with a fluid chamber 61. The valve member 55 defines a plurality of alternating valve passages 63 and 65, the valve passages 63 being in continuous fluid communication with the annular chamber 59, and the valve passages 65 being in continuous fluid communication with the chamber 61. In the subject embodiment, there are six of the valve passages 63, and six of the valve passages 65, corresponding to the six external teeth or lobes of the rotor member 27. The valve member 55 also defines a case drain passage 66 providing fluid communication from a rearward surface 68 of the valve member 55 to the central, case drain region of the motor.

The port plate 19 defines a plurality of fluid passages 67, each of which is disposed to be in continuous fluid communication with the adjacent volume chamber. The port plate 19 also defines a transverse valve surface 71, and the valve member 55 defines a transverse valve surface 73 in sliding, sealing engagement with the valve surface 71. In operation, pressurized fluid entering the fluid port 57 will flow through the annular chamber 59, then through each of the valve passages 63, and through the fluid passages 67 in the port plate 19. This fluid will then enter the expanding volume chambers. The above-described flow of pressurized fluid will result in movement of the rotor member 27, as viewed from the left in FIG. 1, comprising (a) orbiting movement in the clockwise direction, and (b) rotating movement in the counter-clockwise direction. As is well known to those skilled in the art, the above-described flow will also result in counter-clockwise rotation of the valve member 55 and output shaft 31, when viewed in the same direction. Exhaust fluid flowing out of the fluid passages 67 enters the respective valve passages 65 and flows into the fluid chamber 61, then to the fluid port not shown in FIG. 1, and from there, to the reservoir. The operation of the fluid motor described above is conventional, and generally well understood by those skilled in the art.

Figure 2:
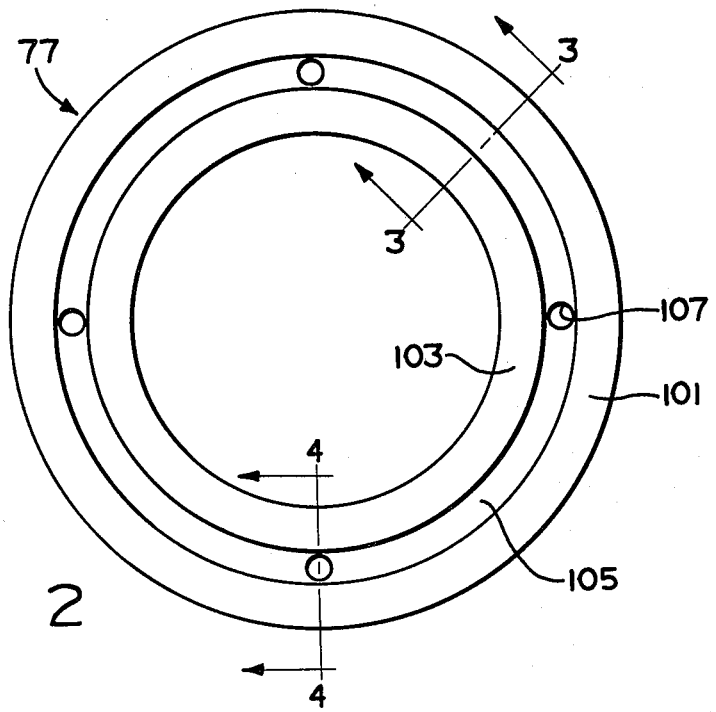
FIG. 2 is an enlarged, front elevation of the balancing ring member of the present invention, taken on line 2—2 of FIG. 1.
Figure 3:
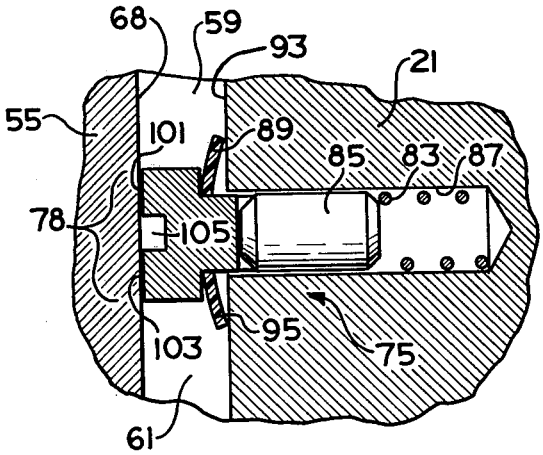
FIG. 3 is a fragmentary, transverse cross section, similar to FIG. 1, taken on line 3—3 of FIG. 2.
Figure 4:
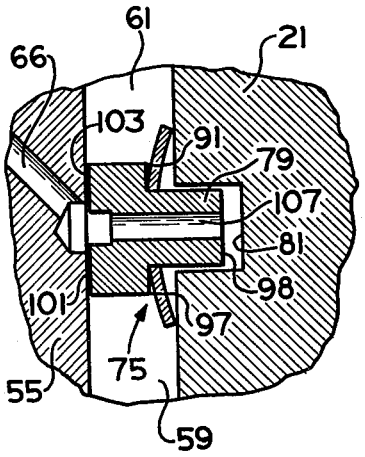
FIG. 4 is a fragmentary, transverse cross section, similar to FIG. 1, taken on line 4—4 of FIG. 2.

Referring now to FIGS. 2, 3, and 4, in conjunction with FIG. 1, the motor 11 includes a valve-seating mechanism, generally designated 75. As is already understood by those skilled in the art, it is necessary to maintain the valve surfaces 71 and 73 in sealing engagement with each other, in order to prevent leakage between valve passages 63 and 65 (i.e., between high pressure and low pressure). However, the forces biasing valve member 55 into engagement with the port plate 19 must be carefully controlled in order to achieve sealing without preventing relative rotation therebetween. The application of such a carefully controlled biasing force is the primary function of the valve seating mechanism 75.

The valve seating mechanism 75 includes an annular balancing ring member 77 having a valve-confronting surface, generally designated 78, which is seated against the rearward surface 68 of the valve member 55, the surface 68 being referred to hereinafter as the opposite surface 68 because it is disposed opposite the valve surface 73. The ring member 77 includes a rearwardly projecting, integral ring portion 79 which is received within an annular, mating groove 81 defined by the valve housing 21 (FIG. 4). In the absence of fluid pressure in either of the chambers 59 or 61, the balancing ring member 77 is biased into engagement with the opposite surface 68 by means of a spring 83 biasing a pin 85 which is received in a notch defined by the ring portion 79. The spring 83 and pin 85 are disposed within a cylindrical bore 87, such that the pin 85 also serves to align the balancing ring 77 and prevent rotation thereof.

Another function of the valve seating mechanism 75 is to separate the high pressure and low pressure fluid contained in the fluid chambers 59 and 61. In order to accomplish this purpose, an outer sealing ring 89 is seated between an outer balancing surface 91 and a transverse end wall 93 defined by the valve housing 21. Similarly, an inner sealing ring 95 is seated between an inner balancing surface 97 and the end wall 93. The balancing ring member 77 of FIGS. 2–4 will be described somewhat greater detail subsequently.

PRIOR ART

Referring now to FIGS. 5 and 6, there will be a brief description of the structure and operation of the balancing ring disclosed in the above-cited U.S. Pat. No. 3,572,983. The prior art balancing ring of FIGS. 5 and 6 comprises a plurality of lands and grooves, including outer lands A and B, inner lands C and D, middle lands E and F, outer grooves G and H, inner grooves J and K and a middle groove L. Outer land A defines a notch M which can permit pressurized fluid to flow from fluid chamber 59 into outer groove G. Similarly, inner land C defines a notch N which can permit pressurized fluid to flow from fluid chamber 61 into inner groove J. The prior art balancing ring also includes four passages or bores O, two of which receive anti-rotation pins (similar to pin 85 of FIG. 3) and two of which permit fluid communication from the valve-confronting surface to a rearward or balancing surface P.

As discussed in the background of the present specification, those skilled in the art have for a long time believed that the problem of stalling was the result of valve lift-off. Therefore, a primary aspect of the present invention is the recognition of a failure mode responsible for at least a major portion of the occurrences of stalling, and which is unrelated to the phenomenon of valve lift-off. The failure mode which, as the primary aspect of this invention, has been recognized and become understood, will now be described. In describing this failure mode, reference will be made to the prior art balancing ring of FIGS. 5 and 6, located in the environment illustrated in FIG. 4. Also, for purposes of description, it will be assumed that the fluid chamber 59 contains high pressure while the fluid chamber 61 is connected to the reservoir and contains low pressure.

During the early stages of operation, high pressure fluid flows through notch M and enters outer groove G, but is largely prevented from entering outer groove H by outer land B. All of the other grooves contain fluid at relatively low pressure, as does the passage O and the drain passage 66. However, if proper system filtration procedures are not followed, or for some other reason, contamination particles are present in the fluid chamber 59, such particles will be carried across land B by the small leakage flow from outer groove G to outer groove H. This leakage flow then passes from groove H into passage O, through middle groove L, then through drain passage 66 to case drain. Initially, this leakage flow is extremely small, and the opposing pressures acting on the valve-confronting surface and balancing surface P are substantially identical.

As contamination wear of the land B increases, however, the leakage flow rate across land B increases, causing an increase in the fluid pressure in outer groove H, and to some extent, in middle groove L. At the same time, the fluid pressure builds in the mating groove 81, and this pressure acts on the underside of the outer and inner sealing rings 89 and 95. The increased fluid pressure acting on the sealing ring 89 is opposed by the high pressure in the fluid chamber 59, but the increased fluid pressure acting on the inner sealing ring 95 is opposed only by the return pressure in the fluid chamber 61. As this fluid pressure in the groove 81 increases, it finally becomes high enough to move the sealing ring 95 out of sealing engagement with the end wall 93. The pressurized fluid in the groove 81 is then permitted to flow past the sealing ring 95 into the fluid chamber 61, and out the low pressure port to the system reservoir. This momentary flow reduces the fluid pressure in the groove 81 resulting in a pressure imbalance across the balancing ring, causing the ring to separate from the opposite surface 68 of the valve member 55. When such separation occurs, relatively unrestricted fluid communication is permitted between the fluid chambers 59 and 61, causing stalling of the motor.

In the prior art balancing ring shown in FIGS. 5 and 6, although the middle groove L is in continuous fluid communication with drain passage 66, its intended function, as described in the specification of U.S. Pat. No. 3,572,983, is merely to communicate a small lubrication flow from whichever of the fluid chambers (59 or 61) contains high pressure to the spline connections, by means of a small radial notch defined by the opposite surface 68 of the valve member 55. Thus, the middle groove L was not included in the prior art balancing ring for the purpose of preventing the previously-described pressure imbalance across the ring, and in the commercial embodiments utilizing the prior art balancing ring, the groove L has not had an appreciable effect on the problem as now recognized in the present invention.

The failure of those skilled in the art to recognize or understand the above-described failure mode is indicated by the configuration of the subsequent prior art balancing ring illustrated in FIGS. 7 and 8. The prior art balancing ring shown in FIGS. 7 and 8 is generally similar to that shown in FIGS. 5 and 6, with two primary exceptions: (1) outer land A is eliminated, making outer groove G somewhat wider; and (2) there is a single middle land E, thus eliminating the middle groove L.

The function and failure mode of the prior art balancing ring of FIG. 7 are generally the same as that of FIG. 5. However, it should be noted that with the elimination of the middle groove L, communication of leakage flow from the outer groove H to the drain passage 66 is even more restricted than in the balancing ring of FIG. 5. In the prior art balancing ring of FIG. 7, the middle land E is wide enough to completely cover the opening to the drain passage 66, such that communication from the groove H to the drain passage 66 is permitted only four times per revolution of the valve member 55, i.e., each time one of the passages O is circumferentially aligned with the drain passage 66. It should be noted that the elimination of the middle groove L and the adoption of the single middle land E of FIG. 7 was primarily for the purpose of increasing the available load bearing area, i.e., the land area in engagement with the opposite surface 68.

Referring again to FIGS. 2, 3, and 4, there will be described one embodiment of the balancing ring which resulted from the recognition of the failure mode described above. In accordance with the present invention, the valve seating mechanism 75 includes a pressure-reducing means which is operable to maintain the pressure differential between the valve-confronting surface 78 and a middle balancing surface 98 less than the equivalent force of the biasing means when fluid flow across either the inner or outer sealing land increases to a substantial portion of total flow from the inlet to the outlet. As used herein, the term "biasing means" should be understood to include not only the spring 83, but also the nominal hydraulic imbalance biasing the ring member 77 toward the left in FIGS. 3 and 4. This hydraulic imbalance includes the force of high pressure fluid acting on either the outer balancing surface 91 or the inner balancing surface 97. The reference to "a substantial portion" of total flow from the inlet to the outlet is intended to mean that the pressure reducing means must be effective to prevent separation of the ring 77 from the valve 55 even after there is sufficient contaminant wear such that the leakage flow is around 30 percent, or even more, of fluid entering the inlet port.

As may best be seen in FIGS. 2 and 3, the valve-confronting surface 78 of the balancing ring member 77 includes an outer sealing land 101, an inner sealing land 103, and a central, annular groove 105. In fluid communication with the groove 105 there are four balancing passages 107, permitting communication between the valve-confronting surface 78 and the middle balancing surface 98. In this embodiment of the present invention, the objective of reducing the pressure differential across the surfaces 78 and 98 is accomplished by sizing the annular groove 105 such that the groove 105 does not present substantial restriction to the flow of leakage fluid to the drain passage 66.

As will be understood by those skilled in the art, if the fluid chamber 59 contains high pressure, the leakage fluid flowing from the chamber 59 to the annular groove 105 will result in a pressure gradient across the outer sealing land 101. This pressure gradient acts on the sealing land 101 biasing the ring member 77 to the right in FIG. 3, and at the same time, high pressure acts on the outer balancing surface 91 to bias the ring member 77 to the left in FIG. 3. The area of the sealing land vs. the area of the balancing surface (101 vs. 97 or 103 vs. 91) is selected such that there is a net biasing force to the left if FIG. 3, and this biasing force constitutes the nominal hydraulic imbalance referred to hereinabove.

In the embodiment of the invention shown in FIGS. 2–4, the leakage fluid which flows across whichever of the sealing lands is subjected to high pressure fluid flows through annular groove 105 and is in constant fluid communication with drain passage 66. As a result, there is no build-up of fluid pressure acting on the valve-confronting surface 78 which, in turn, could result in increased fluid pressure in the mating groove 81 as previously described. Therefore, there will not be sufficient fluid pressure acting on the sealing ring (89 or 95) to disengage it from the end wall 93 and permit a flow of fluid from the groove 81 to the low pressure chamber (59 or 61). Preventing flow from the groove 81 also prevents flow through the balancing passages 107 (to the right in FIG. 4) and as a result, prevents the build-up of a pressure differential between the valve-confronting surface 78 and the balancing surface 98. It should be understood by those skilled in the art, from a reading of the specification, that it is necessary in accordance with this invention to maintain the above-referenced pressure differential below the equivalent force of the "biasing means" which, as described hereinabove includes the force of the springs 83 as well as the nominal hydraulic imbalance biasing the ring member 77 toward the left in FIGS. 3 and 4.

ALTERNATIVE EMBODIMENTS

Referring now to FIG. 9, there is illustrated an alternative embodiment of the present invention, in which like elements bear like numerals, and new elements bear numerals in excess of 200. In the embodiment of FIG. 9, the object of maintaining the differential across the balancing ring 77 below the equivalent force of the biasing means is accomplished by introducing positive seal means to prevent fluid flow out of the groove 81, and therefore, prevent flow through the balancing passages 107. In order to accommodate a seal in the FIG. 9 embodiment, the valve housing 21 is modified such that the groove 81 includes an outer stepped portion 201 and an inner stepped portion 203. In addition, the balancing ring member 77 includes an outer shoulder 205 and an inner shoulder 207. The stepped portion 201 and shoulder 205 define an outer annular seal chamber and similarly, the stepped portion 203 and shoulder 207 define an inner annular seal chamber.

Disposed within the outer seal chamber is an outer sealing means including a rectangular seal 211, preferably made from a material such as polytetrafluoroethylene and having anti-extrusion properties. The seal means further includes some type of conventional rubber seal 213. Similarly, there is disposed in the inner sealing chamber a seal means including a rectangular seal 215 (which is preferably the same as the seal 211) and a rubber seal 217 (which is preferably the same as the seal 213.)

Referring now to FIG. 10, there is illustrated another alternative embodiment of the invention in which like elements bear like numerals and new elements bear numerals in excess of 300. The embodiment of FIG. 10 is substantially identical to the embodiment of FIGS. 2–4 in overall configuration, and in general function. However, in the FIG. 10 embodiment, the balancing ring member 77 comprises an outer ring half 301 and an inner ring half 303, the ring halves 301 and 303 being independently axially movable.

By way of explanation of the operation of the FIG. 10 embodiment, it should be noted that in the embodiment of FIGS. 2–4, the outer and inner sealing lands 101 and 103 have equal wear compensation only if the duty cycle of the motor in the clockwise direction is exactly the same as the duty cycle in the counterclockwise direction. As used herein, the term "duty cycle" relates not only to time of operation, but also to pressure differential and speed of operation. As will be appreciated by those skilled in the art, the duty cycles in the clockwise and counterclockwise directions are normally quite different in actual practice, and therefore, the wear of the sealing lands 101 and 103 is normally quite different. In the alternative embodiment of FIG. 10, because the ring halves 301 and 303 are independently axially movable, each of the sealing lands 101 and 103 is independently wear compensated. It should be understood by those skilled in the art that each of the ring halves 301 and 303 is hydraulically "balanced" (or imbalanced) in the same manner as was described for the embodiment of FIGS. 2–4.

In FIG. 10, the pin 85 of FIG. 3 has been replaced by a pin 305 having a greater diametral clearance relative to the bore 87. As a result, the axis of the pin 305 is not constrained to remain coincident with the axis of the bore 87, and if there is uneven wear of the sealing lands 101 and 103, the pin 305 will "rock" or "tilt" to maintain the bias of the spring 83 on both of the ring halves 301 and 303, regardless of the relative amounts of wear of the sealing lands 101 and 103.

It is believed that various other alterations and embodiments of the present invention will occur to those skilled in the art upon a reading and understanding of the present specification, and it is intended that all such alterations and modifications are included within the present invention, insofar as they come within the scope of the appended claims.

I claim:

1. A rotary fluid pressure device comprising:

(a) housing means defining fluid inlet means and fluid outlet means;

(b) fluid energy-translating displacement means defining expanding and contracting fluid volume chambers;

(c) stationary valve means defining fluid passage means in fluid communication with said expanding and contracting volume chambers and having a first valve surface;

(d) a rotary valve member defining valve passage means providing fluid communication between said inlet and outlet means and said fluid passage means and having a second valve surface in sliding, sealing engagement with said first valve surface and further having an opposite surface;

(e) a valve-seating mechanism including a generally annular balancing ring member having a transverse valve-confronting surface in engagement with said opposite surface of said rotary valve member, and a balancing surface, said balancing ring member being axially movable relative to said rotary valve member, said valve-seating mechanism including means biasing said valve-confronting surface into tight sealing engagement with said opposite surface, said balancing ring member cooperating with said housing means and said rotary valve member to define a first fluid chamber disposed radially inwardly from said ring member and a second fluid chamber disposed radially outwardly from said ring member, said fluid inlet means being in fluid communication with one of said first and second chambers and said fluid outlet means being in fluid communication with the other of said first and second chambers;

(f) said valve-seating mechanism defining balancing passage means permitting fluid communication between said valve-confronting surface and said balancing surface;

(g) said valve-confronting surface defining inner and outer sealing land means disposed to restrict fluid communication from said first and second fluid chambers, respectively, to said balancing passage means; and (h) said valve-seating mechanism including pressure-reducing means operable to maintain the pressure differential between said valve-confronting surface and said balancing surface less than the equivalent force of said biasing means when fluid flow across one of said inner and outer sealing land means increases to a substantial portion of total flow from said fluid inlet means to said fluid outlet means.

2. A rotary fluid pressure device as claimed in claim 1 wherein said pressure-reducing means comprises means permitting substantially unrestricted fluid communication of leakage fluid flowing across one of said sealing land means to a case drain.

3. A rotary fluid pressure device as claimed in claim 1 wherein said pressure-reducing means comprises means for substantially preventing fluid flow through said balancing passage means.

4. A rotary fluid pressure device as claimed in claim 3 wherein said flow preventing means comprises sealing means disposed to substantially prevent fluid flow from said balancing passage means to the one of said first and second fluid chambers in communication with said fluid outlet means.

5. A rotary fluid pressure device as claimed in claim 1 wherein said balancing ring member comprises an outer ring half and an inner ring half, said ring halves being independently axially movable.

6. A rotary fluid pressure device as claimed in claim 5 wherein said biasing means is operable to bias said ring halves independently to compensate for different amounts of wear of said inner and outer sealing land means.

7. A rotary fluid pressure device comprising:

(a) housing means defining a high pressure fluid port, and a low pressure fluid port;

(b) an internal gear set associated with said housing means and including an internally toothed member, and an externally toothed member eccentrically disposed within said internally toothed member for relative movement therebetween, the teeth of said members interengaging to define expanding and contracting volume chambers during said relative movement, one of said members having rotational movement about its own axis, and one of said members having orbital movement about the axis of the other of said members;

(c) input-output shaft means operable to transmit said rotational movement of said one of said members;

(d) stationary valve means defining fluid passage means in fluid communication with said expanding and contracting volume chambers and having a first valve surface;

(e) a rotary valve member being movable in synchronism one of said movements of one of said toothed members, said rotary valve member defining valve passage means providing fluid communication between said high and low pressure fluid ports and said fluid passage means, and having a second valve surface in sliding, sealing engagement with said first valve surface and further having an opposite surface;

(f) a valve seating mechanism including a generally annular balancing ring member having a transverse valve-confronting surface in engagement with said opposite surface of said rotary valve member, and a balancing surface, said balancing ring member being axially movable relative to said rotary valve member, said valve seating mechanism including means biasing said valve-confronting surface into tight sealing engagement with said opposite surface, said balancing ring member cooperating with said housing means and said rotary valve member to define a first fluid chamber disposed radially inwardly from said ring member and a second fluid chamber disposed radially outwardly from said ring member, said high pressure fluid port being in fluid communication with one of said first and second chambers, and said low pressure fluid port being in fluid communication with the other of said first and second chambers;

(g) said balancing ring member defining balancing passage means permitting fluid communication between said valve-confronting surface and said balancing surface;

(h) said valve-confronting surface defining inner and outer sealing land means disposed to restrict fluid communication from said first and second fluid chambers, respectively, to said balancing passage means; and (j) said valve-seating mechanism including said valve-confronting surface of said balancing ring member defining an annular groove disposed between said inner and outer sealing land means, and in continuous fluid communication with said balancing passage means, said rotary valve member defining drain passage means disposed in continuous fluid communication with said annular groove to permit sufficient fluid flow through said drain passage means to maintain the pressure differential between said valve-confronting surface and said balancing surface below the equivalent force of said biasing means when fluid flow across one of said inner and outer sealing land means increases to a substantial portion of total flow between said high pressure fluid port and said low pressure fluid port.

8. A rotary fluid pressure device comprising:

(a) housing means defining fluid inlet means and fluid outlet means;

(b) fluid energy-translating displacement means defining expanding and contracting fluid volume chambers;

(c) stationary valve means defining fluid passage means in fluid communication with said expanding and contracting volume chambers and having a first valve surface;

(d) a rotary valve member defining valve passage means providing fluid communication between said inlet and outlet means and said fluid passage means and having a second valve surface in sliding, sealing engagement with said first valve surface and further having an opposite surface;

(e) a valve-seating mechanism including a generally annular balancing ring member having a transverse valve-confronting surface in engagement with said opposite surface of said rotary valve member, and a balancing surface, said balancing ring member being axially movable relative to said rotary valve member, said valve-seating mechanism including means biasing said valve-confronting surface into tight sealing engagement with said opposite surface, said balancing ring member cooperating with said housing means and said rotary valve member to define a first fluid chamber disposed radially inwardly from said ring member and a second fluid chamber disposed radially outwardly from said ring member, said fluid inlet means being in fluid communication with one of said first and second chambers and said fluid outlet means being in fluid communication with the other of said first and second chambers;

(f) said valve-seating mechanism defining balancing passage means permitting fluid communication between said valve-confronting surface and said balancing surface;

(g) said valve-confronting surface defining inner and outer sealing land means disposed to restrict fluid communication from said first and second fluid chambers, respectively, to said balancing passage means; and (h) said valve-seating mechanism including said rotary valve member defining a drain passage communicating with a case drain region of said device, and further including said valve-confronting surface of said balancing ring member and said opposite surface of said valve member cooperating to define an annular groove disposed between said inner and outer sealing land means and in continuous fluid communication with said drain passage, said annular groove being sized to provide fluid communication from said groove to the entire cross sectional flow area of said drain passage, to prevent sufficient build-up of pressure in said annular groove to overcome the equivalent force of said biasing means when fluid flow across one of said inner and outer sealing land means increases to a substantial portion of total flow from said fluid inlet means to said fluid outlet means.

* * * * *